US008091363B2

(12) United States Patent
Sullivan et al.

(10) Patent No.: US 8,091,363 B2
(45) Date of Patent: Jan. 10, 2012

(54) LOW RESIDENCE COMBUSTOR FUEL NOZZLE

(75) Inventors: Daniel J. Sullivan, Jupiter, FL (US); Peter Stuttaford, Jupiter, FL (US); Robert J. Kraft, Tequesta, FL (US); Khalid Oumejjoud, Riviera Beach, FL (US); Yan Chen, Palm Beach Gardens, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 1076 days.

(21) Appl. No.: 11/998,769

(22) Filed: Nov. 29, 2007

(65) Prior Publication Data

US 2009/0139237 A1 Jun. 4, 2009

(51) Int. Cl.
*F02C 1/00* (2006.01)
*B05B 7/10* (2006.01)

(52) U.S. Cl. ..... 60/748; 239/399

(58) Field of Classification Search ..... 60/734, 60/737, 742, 746, 747, 748, 752, 776, 804; 239/399, 533.2, 590
See application file for complete search history.

(56) References Cited

U.S. PATENT DOCUMENTS

| | | | | |
|---|---|---|---|---|
| 1,451,063 | A * | 4/1923 | Anthony | 239/406 |
| 4,271,675 | A | 6/1981 | Jones et al. | |
| 4,292,801 | A | 10/1981 | Wilkes et al. | |
| 4,420,929 | A | 12/1983 | Jorgensen et al. | |
| 4,798,330 | A | 1/1989 | Mancini et al. | |
| 6,082,111 | A * | 7/2000 | Stokes | 60/737 |
| 6,446,439 | B1 * | 9/2002 | Kraft et al. | 60/739 |
| 7,024,861 | B2 * | 4/2006 | Martling | 60/737 |
| 7,377,036 | B2 * | 5/2008 | Johnson et al. | 29/889.1 |
| 2005/0061004 | A1 | 3/2005 | Colibaba-Evulet et al. | |

* cited by examiner

*Primary Examiner* — William Rodriguez
*Assistant Examiner* — Arun Goyal
(74) *Attorney, Agent, or Firm* — Shook, Hardy & Bacon L.L.P.

(57) ABSTRACT

Embodiments for an apparatus and associated method for reducing the residence time in a gas turbine combustor are disclosed. The embodiments of the present invention comprise a fuel nozzle that extends to a downstream plane of an end cap for a combustion liner where the axial distance of the premixer is reduced, however the swirl for mixing the fuel and air, is increased. As a result, the mixing of the fuel and air is essentially unchanged, thereby allowing higher air pressures and operating temperatures within the premixer without inducing auto-ignition.

17 Claims, 9 Drawing Sheets
(2 of 9 Drawing Sheet(s) Filed in Color)

LOW RESIDENCE COMBUSTOR FUEL NOZZLE

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The present invention relates to gas turbine engines. More particularly, embodiments of the present invention relate to an apparatus and a method for reducing a residence time in a combustor of a gas turbine engine.

BACKGROUND OF THE INVENTION

Gas turbine engines operate to produce mechanical work or thrust. Land-based gas turbine engines typically have a generator coupled thereto for the purposes of generating electricity. In operation, fuel is directed through a fuel nozzle where it mixes with compressed air in the combustor and is ignited to form hot combustion gases. These hot combustion gases then pass through the turbine, thereby driving the turbine, which is coupled to a compressor.

The fuel and air mixture is present in a premixer portion of the combustor for only a relatively brief period of time. However, maintaining the fuel and air mixture in the premixer for an extended period of time at an elevated temperature and pressure can lead to auto ignition. As pressure and temperature of the mixture rise, the conditions become more favorable for auto ignition to occur. In the event auto ignition of the fuel and air mixture occurs, damage to the combustion system, high emissions levels, and elevated combustion dynamics are some possible and undesirable results.

SUMMARY OF THE INVENTION

The present invention provides embodiments for an apparatus and associated method for reducing the residence time of a fuel and air mixture in a gas turbine combustor while maintaining combustor performance with respect to ignition and emissions. In an embodiment of the present invention a fuel nozzle for a gas turbine combustor is disclosed having a centerbody, a plurality of swirlers extending from the centerbody, and an outer shroud extending from the centerbody and radially encompassing the swirlers, thereby creating a passageway between the centerbody and the outer shroud. Air is drawn into the passageway and mixes with fuel from the centerbody as the air and fuel exit the fuel nozzle.

In an additional embodiment, a method of minimizing auto ignition of a gaseous fuel and air mixture in a combustor is disclosed. In this method, at least one fuel nozzle is re-positioned to an exit plane of a combustion liner end cap, such that the residence time of the fuel and air mixture in the premixing chamber of the combustion liner is reduced. To compensate for this shorter residence time, but not adversely impacting mixedness of the fuel and air and hence emissions, the swirler angle of the fuel nozzle is increased such that the mixedness of the fuel and air entering the combustor is relatively unchanged.

In a further embodiment, a gas turbine combustor is provided comprising a combustion liner having one or more combustion chambers, an end cap affixed to the combustion liner, and at least one fuel nozzle received in the end cap. The at least one fuel nozzle comprises a centerbody, a plurality of swirlers extending from the centerbody, and an outer shroud extending from the centerbody and radially encompassing the swirlers, thereby creating a passageway between the centerbody and the outer shroud. Air is drawn into the passageway and mixes with fuel from the centerbody as the air and fuel exit the fuel nozzle. The fuel nozzle is positioned proximate a plane defined by an intersection of the end cap and the combustion liner, whereby a distance and associated time between where fuel is injected from the at least one fuel nozzle and the combustion chamber are reduced, while maintaining mixedness conditions of the air and fuel.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWING

The patent or application file contains at least one drawing executed in color. Copies of this patent or patent application publication with color drawing(s) will be provided by the Office upon request and payment of the necessary fee.

The present invention is described in detail below with reference to the attached drawing figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

Figure 1:
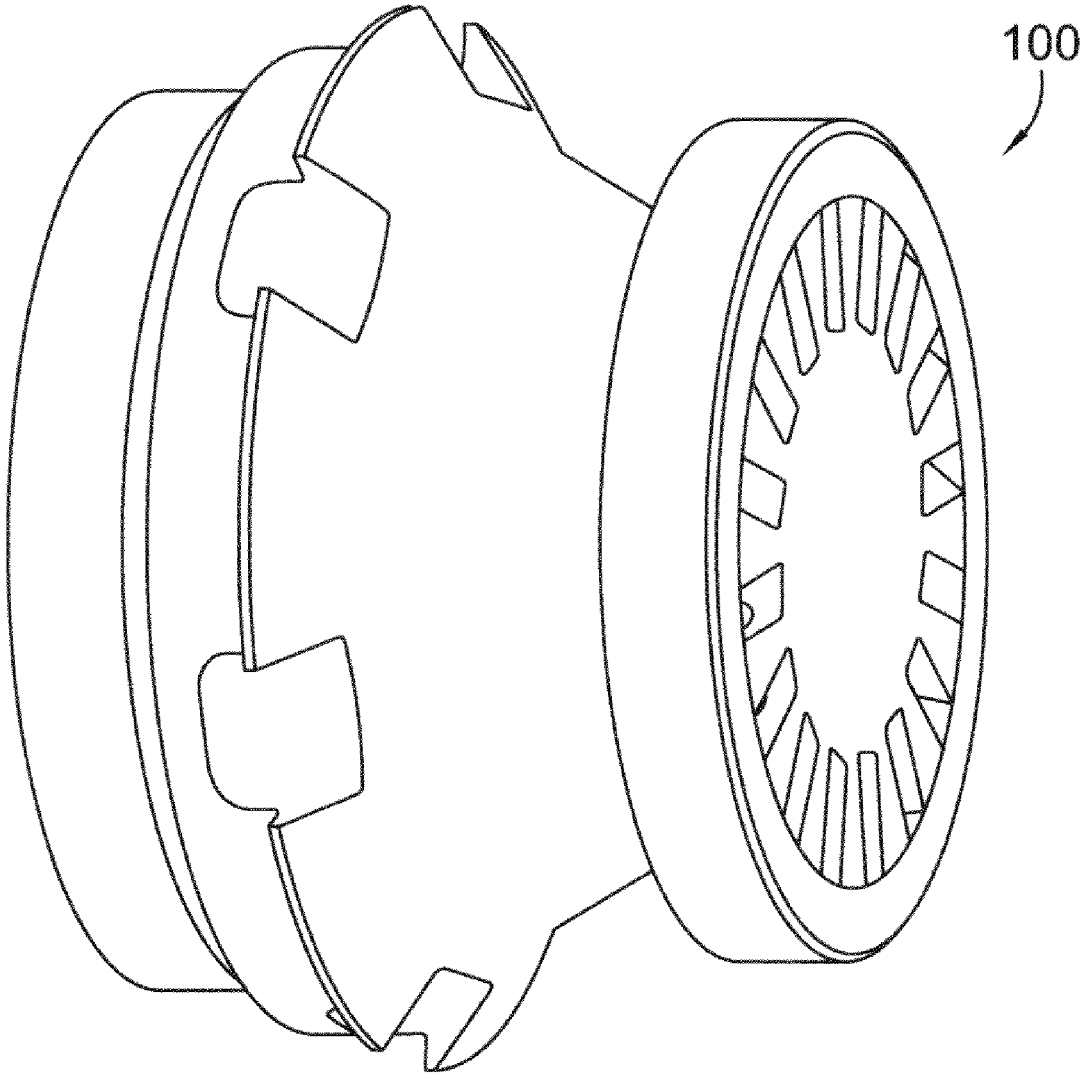
FIG. 1. PRIOR ART
FIG. 1 depicts a perspective view of a fuel nozzle of the prior art.
Figure 2:
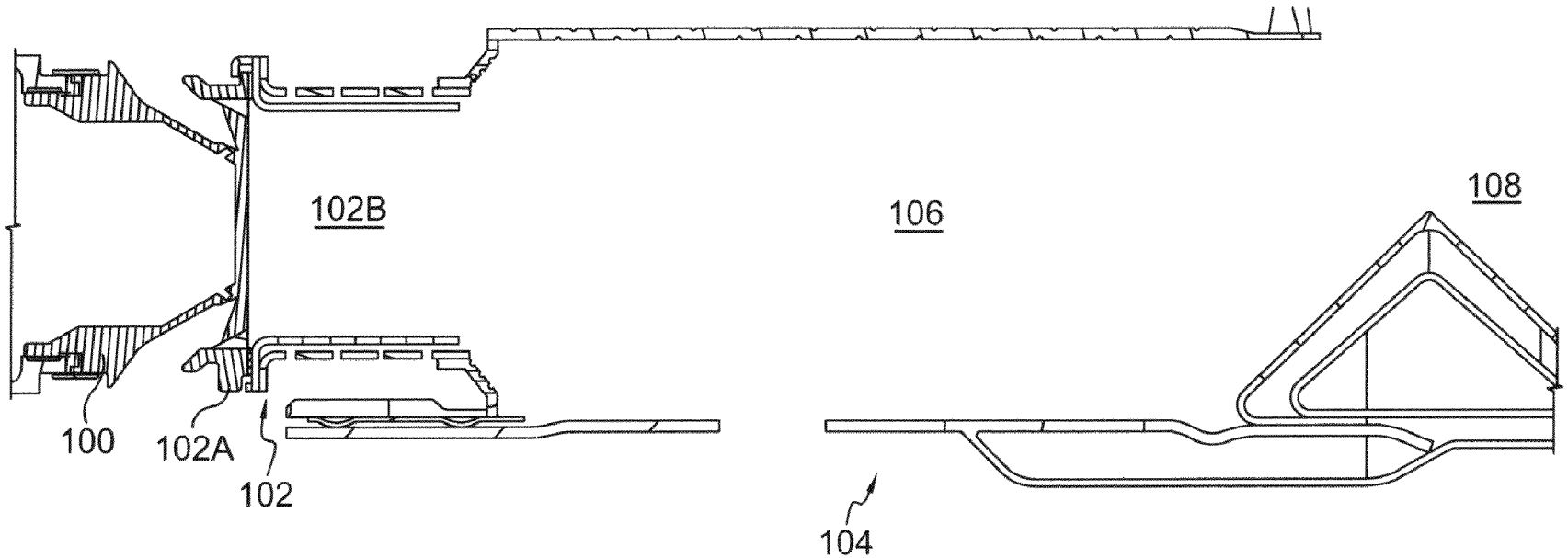
FIG. 2. PRIOR ART
FIG. 2 depicts a cross section view of a portion of a gas turbine combustor that utilizes a fuel nozzle of the prior art.
Figure 3:
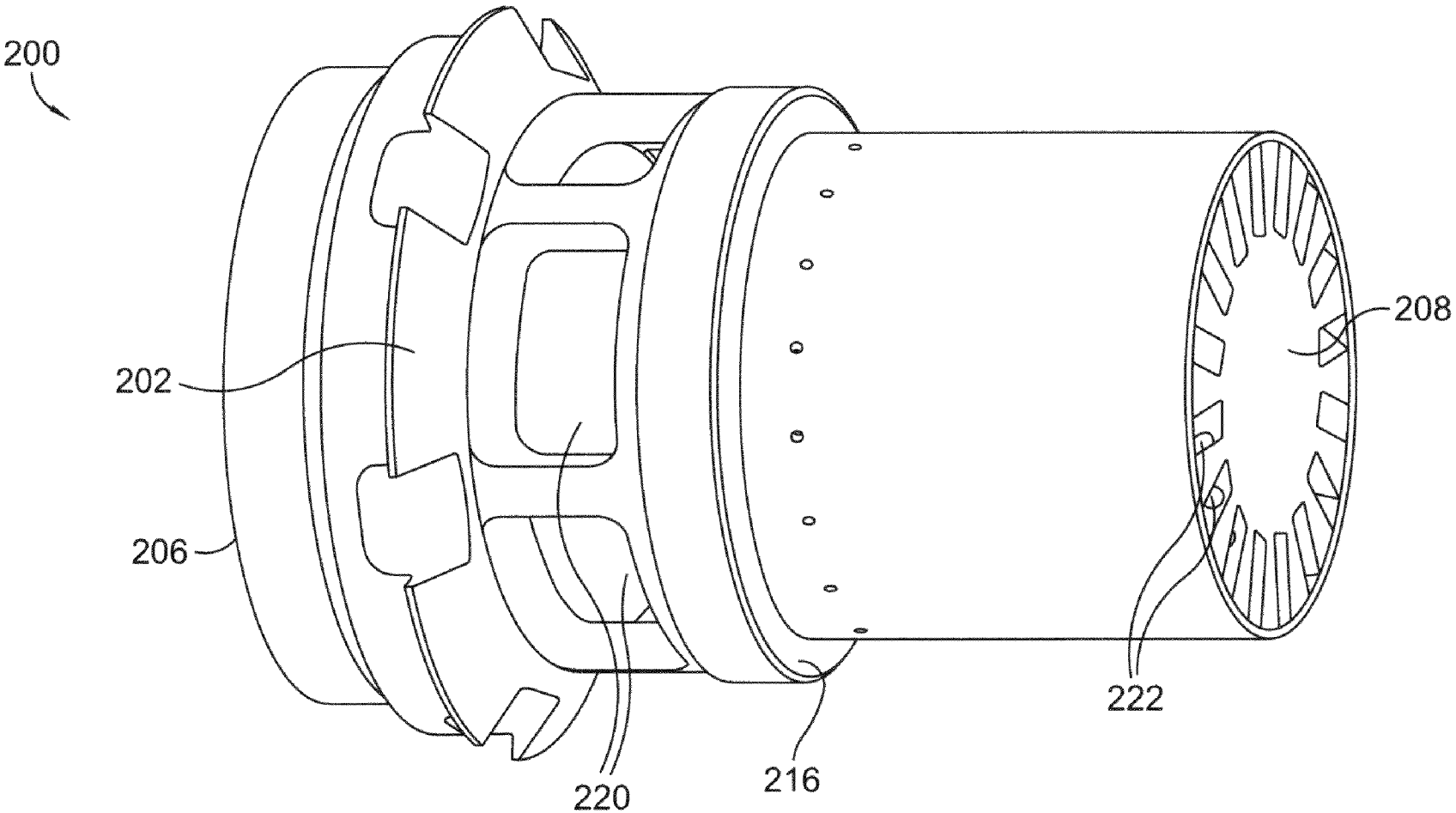
FIG. 3 depicts a perspective view of a fuel nozzle in accordance with an embodiment of the present invention.
Figure 4:
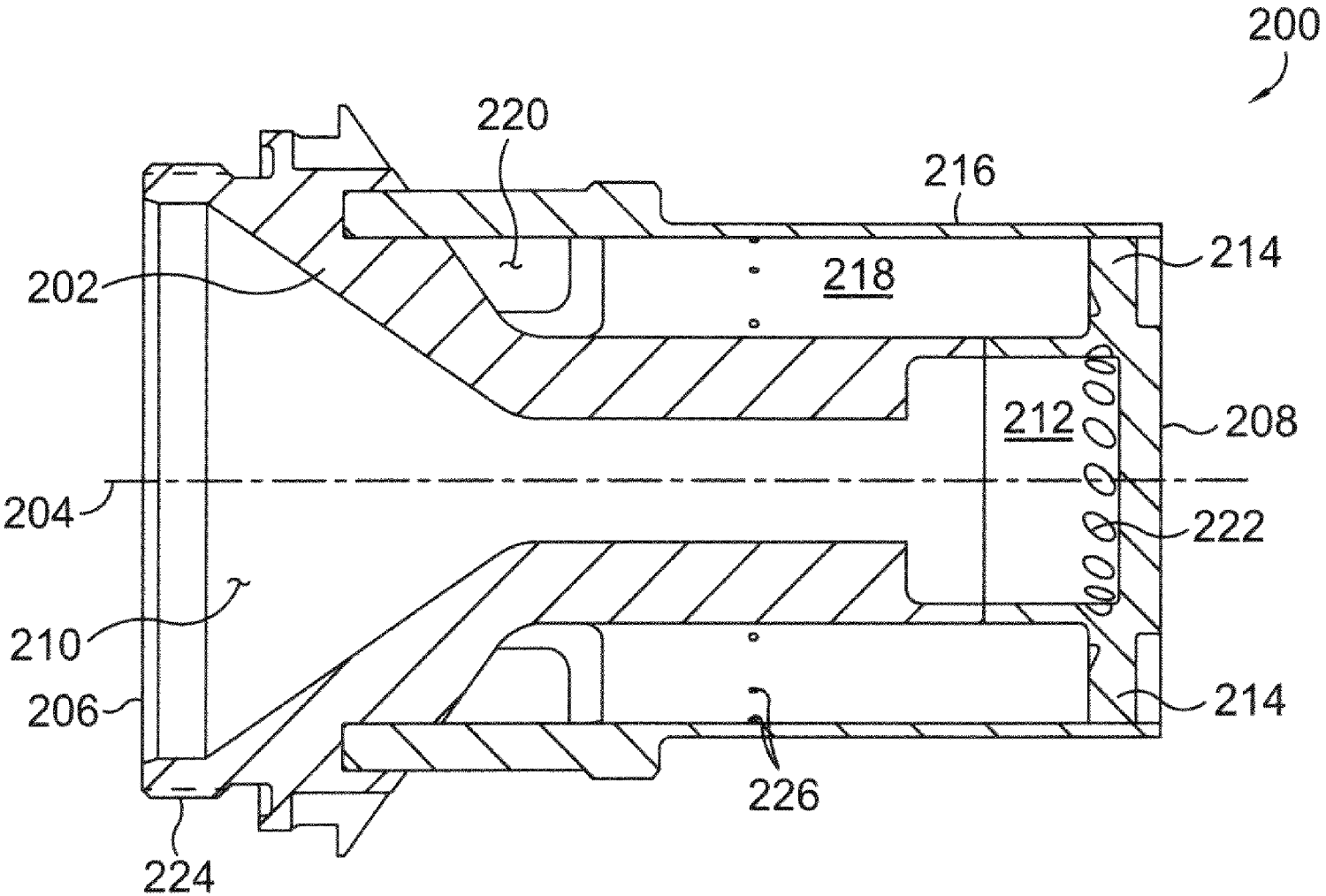
FIG. 4 depicts a cross section view of the fuel nozzle of FIG. 3.

Referring initially to FIG. 1, a perspective view of a fuel nozzle 100 in accordance with the prior art is shown. In FIG. 2, the fuel nozzle 100 is shown in cross section as installed in an end cap 102, which is in turn installed in a combustion liner 104. The fuel nozzle 100 is positioned towards a forward or upstream end 102A of the end cap 102 so as to create an extended chamber 102B for premixing fuel and air prior to entry into the premixer 106 of the combustion liner 104. The fuel/air mixture resides in the extended chamber 102B and premixer 106 for a specific time period, commonly referred to as a residence time. This time period is a function of combustor geometry, pressure, and temperature prior to entering a combustion chamber 108. As previously discussed, there are limits to the residence time as the pressure and temperature levels of the fuel/air mixture increase before auto ignition of the mixture occurs.

Embodiments of the present invention is shown in detail in FIGS. 3-6. A fuel nozzle 200 comprises a centerbody 202 extending along a nozzle axis 204, the centerbody 202 having a first end 206 and a second end 208 located opposite of the first end 206. The centerbody 202 also comprises a first opening 210 that extends from the first end 206 through the centerbody 202 to a plenum 212, with the first opening 210 that tapers from a generally conical cross section to a generally cylindrical cross section. The centerbody 202 also comprises a threaded portion 224 that is located proximate the first end 206 along an outer portion of the centerbody 202. The threaded portion 224 allows the fuel nozzle 200 to be removably coupled to a fuel source, such as a combustor end cover (not shown).

Extending radially outward from the centerbody 202, proximate the second end 208 is a plurality of swirlers 214 that are oriented at an angle relative to the nozzle axis 204. This angle is preferably approximately 35 degrees but can be smaller or larger depending on the amount of swirl that is to be imparted to a flow passing therethrough. The effects of this angle will be discussed in more detail below. An outer shroud 216 extends from the centerbody 202 to the second end 208 of the fuel nozzle and encompasses the plurality of swirlers 214. Due to the outer shroud 216 being radially outward of the cylindrical portion of the centerbody 202, a passageway 218 is formed therebetween. The outer shroud 216 also has a plurality of slots 220 that are in fluid communication with the passageway 218, which is in turn in fluid communication with the plurality of swirlers 214. Located adjacent the plurality of swirlers 214 is a plurality of second openings 222.

In operation, a gaseous fuel passes from a fuel source, through the first opening 210, into the plenum 212, and then through the plurality of second openings 222. In addition to exiting through the plurality of second openings 222, the fuel also impinges on the second end 208 of the fuel nozzle 200 to provide active cooling to the fuel nozzle second end 208. The temperature of the gaseous fuel can reach 300 deg. Fahrenheit, whereas the operating temperature to which the fuel nozzle of the combustor is exposed is approximately 1000-4000 deg. Fahrenheit. With the length of the fuel nozzle 200 being extended compared to that of the fuel nozzle 100 of the prior art, the fuel nozzle 200 is positioned further towards the combustor, and therefore, a dedicated cooling to the second end 208 is required, since the second end 208 is now closer to the maximum combustor operating temperatures than the fuel nozzle 100 of the prior art.

A flow of compressed air passes through the plurality of slots 220, through the passageway 218, and then through the plurality of swirlers 214. This air is swirled so as to mix with the fuel particles from the plurality of second openings 222. While a majority of the air passes through the plurality of swirlers 214, a small portion of the air passes through a plurality of third openings 226, which are located circumferentially about the outer shroud 216. The air that passes through the plurality of third openings 226, cools the outer shroud 216 and purges the outer surface of the outer shroud 216 of any fuel particles that might otherwise ignite along the outer surface.

In an alternate embodiment of the present invention, a gas turbine combustor 250 has a reduced residence time for a fuel/air mixture passing through, and comprises a combustion liner 252 having a first liner end 254 and a second liner end 256 located opposite of the first liner end 254 and separated by one or more combustion chambers 258. The combustion liner 252 is preferably generally annular and has a central axis A-A. Affixed to the first liner end 254 is an end cap 260 having at least one receptacle 262. This embodiment of the present invention also comprises at least one fuel nozzle 200 that extends through the at least one receptacle 262 of the end cap. It should be noted that the present invention incorporates multiple fuel nozzles 200 and associated receptacles 262 that are located in an annular array about the central liner axis A-A.

The fuel nozzle 200, as previously discussed, is used in conjunction with the combustion liner 252 and the end cap 260 such that the fuel nozzle 200 is positioned proximate a plane 264 defined by a downstream face of the end cap 260. The placement of the at least one fuel nozzle 200 at this location reduces the axial distance, and therefore, the associated mixing time in a premixer 270, which is generally between where fuel is injected and the combustion chamber 258. However, the angle of the plurality of swirlers 214 have also been increased to increase mixing rate, thereby compensating for the reduced axial mixing distance. As a result, the fuel and air mixedness in the combustion chamber 258 are relatively unchanged, as will be discussed in more detail below, but the residence time has been reduced. As one skilled in the art understands, the selection of the swirler angle is not exclusively for the sake of mixing. Fuel nozzle swirler angle is selected based on several considerations including pressure drop, ignition characteristics, fuel nozzle temperature, desired mixing, and size of recirculation zone associated with the fuel nozzle and combustor.

Figure 5:
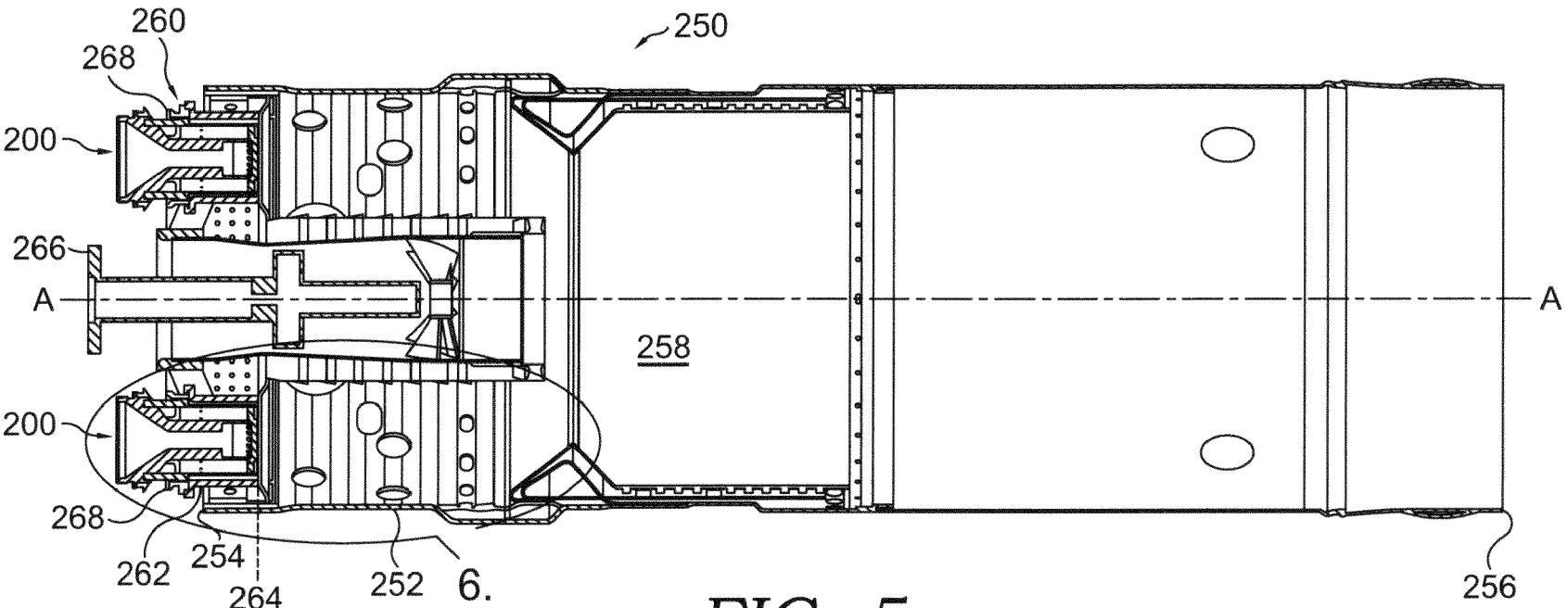
FIG. 5 depicts a cross section view of a portion of a gas turbine combustor utilizing the fuel nozzle of FIG. 3.

In an embodiment of the present invention, the gas turbine combustor 250 further comprises a longitudinally extending secondary fuel nozzle 266 that is located generally along the central liner axis. The at least one fuel nozzle 200 is positioned radially outward and about the secondary fuel nozzle 266, as shown in FIG. 5. The at least one fuel nozzle 200 operates in conjunction with the secondary fuel nozzle 266 to reduce the combustion dynamics of the gas turbine combustor 250 since all fuel injection points have been moved closer to the combustion chamber 258.

The plurality of swirlers 214 and a portion of the centerbody 202 that form the plenum 212 are fabricated from a nickel-based alloy. The remainder of the centerbody 202 and the outer shroud 216 are fabricated from a stainless steel, such as series 410 stainless steel. For an embodiment of the present invention, the swirlers 214 and portion of plenum 212 are fabricated from Hastelloy-X™, since this alloy has a higher temperature capability than that of stainless steel and a higher temperature capability is necessary since the swirlers 214 are positioned closer to the flame front, and therefore operate at a higher temperature.

A variety of manufacturing techniques can be used to fabricate the fuel nozzle 200. However, it is preferred that the centerbody 202 is essentially fabricated from a single piece of material. The plurality of swirlers 214 and portion of the plenum 212 are fabricated from a single piece of material as well. These two components are then fixed together by a means such as welding, although alternate processes could be utilized. Then, the sleeve 216 is placed around the centerbody 202 and the plurality of swirlers 214 and is then brazed to the centerbody 202. The end of the sleeve 216 adjacent to the plurality of swirlers 214 is not fixed to the plurality of swirlers 214 to account for thermal gradients and minimize thermally induced stresses.

Protective coatings can also be applied, if desired, to either or both the threaded portion 224, and a portion of the outer sleeve 216. The chrome plating protects the threads from damage in handling and assembly to other combustion equipment and is preferably applied after the outer sleeve has been brazed to the centerbody 202. The coating applied to the outer sleeve is a hardfacing that protects the outer sleeve by directing any wear that occurs as a result of interaction between the fuel nozzle 200 and the receptacle 262 of the end cap 260 towards a collar 268 at the receptacle 262.

In an alternate embodiment of the present invention, a method of minimizing auto-ignition of a gaseous fuel and air mixture in a combustor is disclosed in which at least one fuel nozzle 200 is re-positioned within the gas turbine combustor further downstream towards the at least one combustion chamber 258. The repositioned fuel nozzle 200 is combined with a change in the angle of the plurality of swirlers 214, which for an embodiment of the invention is approximately 35 degrees, so as to compensate for the reduced axial mixing distance of the fuel and air exiting from the at least one fuel nozzle 200.

In operation, the fuel and air mix upon exit from the plurality of second openings 222 and plurality of swirlers 214, respectively. As a result of the re-positioning of the at least one fuel nozzle 200 within the combustor and the increased swirler angle, an unmixedness parameter of less than 20% occurs (where a perfectly uniform mixture would have an unmixedness parameter of 0%). The unmixedness parameter, as one skilled in the art will understand, is the percentage of fuel that does not mix with the air flow at the entrance to the combustion chamber. This determination was made analytically using computational fluid dynamics (CFD) simulations. For this model, the unmixedness parameter is defined as:

$$Unmixedness = \frac{\left(\int \sqrt{(\Phi - \overline{\Phi})^2}\, d\dot{m}\right)}{\dot{M}\overline{\Phi}}$$

where $$\Phi = \frac{F/A}{(F/A)_{stoic}}$$

and F/A is the fuel to air ratio. $\overline{\Phi}$ is defined as an average equivalence ratio and is taken at the area of interest, which for the present invention, is located at an exit plane of the venturi (adjacent to 258 of FIG. 6), while $\dot{M}$ is defined as the total mass flow (fuel and air), and $d\dot{m}$ is an incremental cell mass flow.

Figure 6:
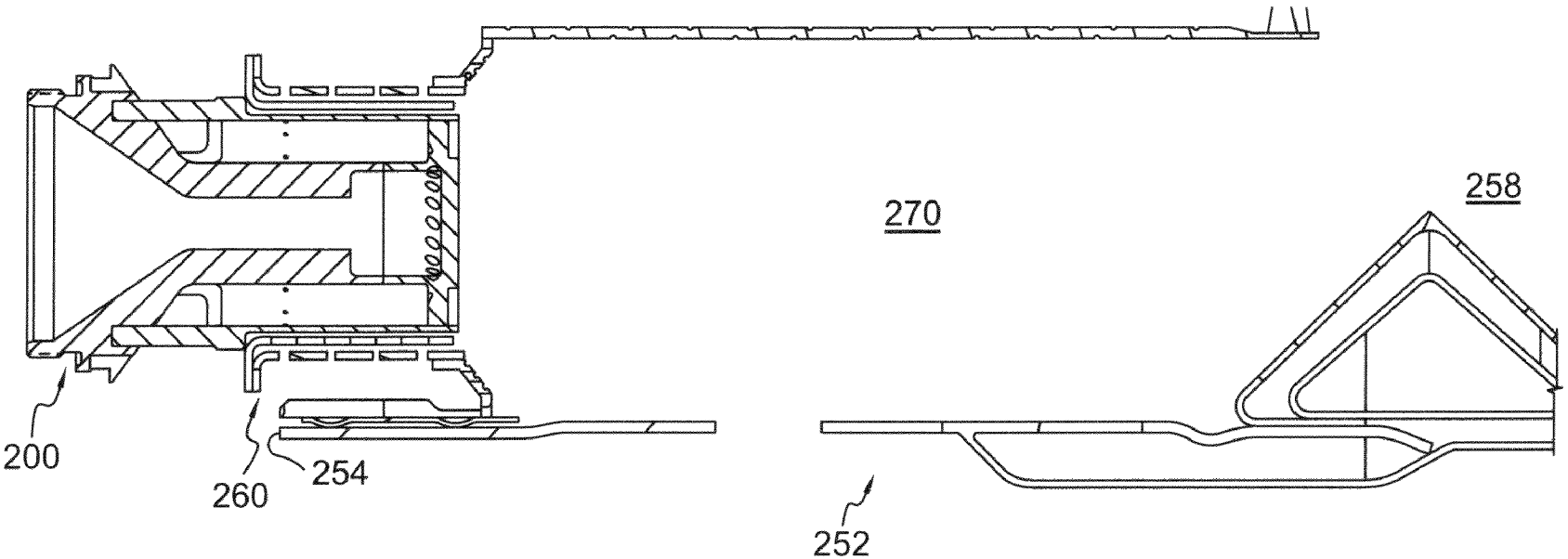
FIG. 6 depicts a detailed cross section view of a portion of a gas turbine combustor of FIG. 5.
Figure 7:
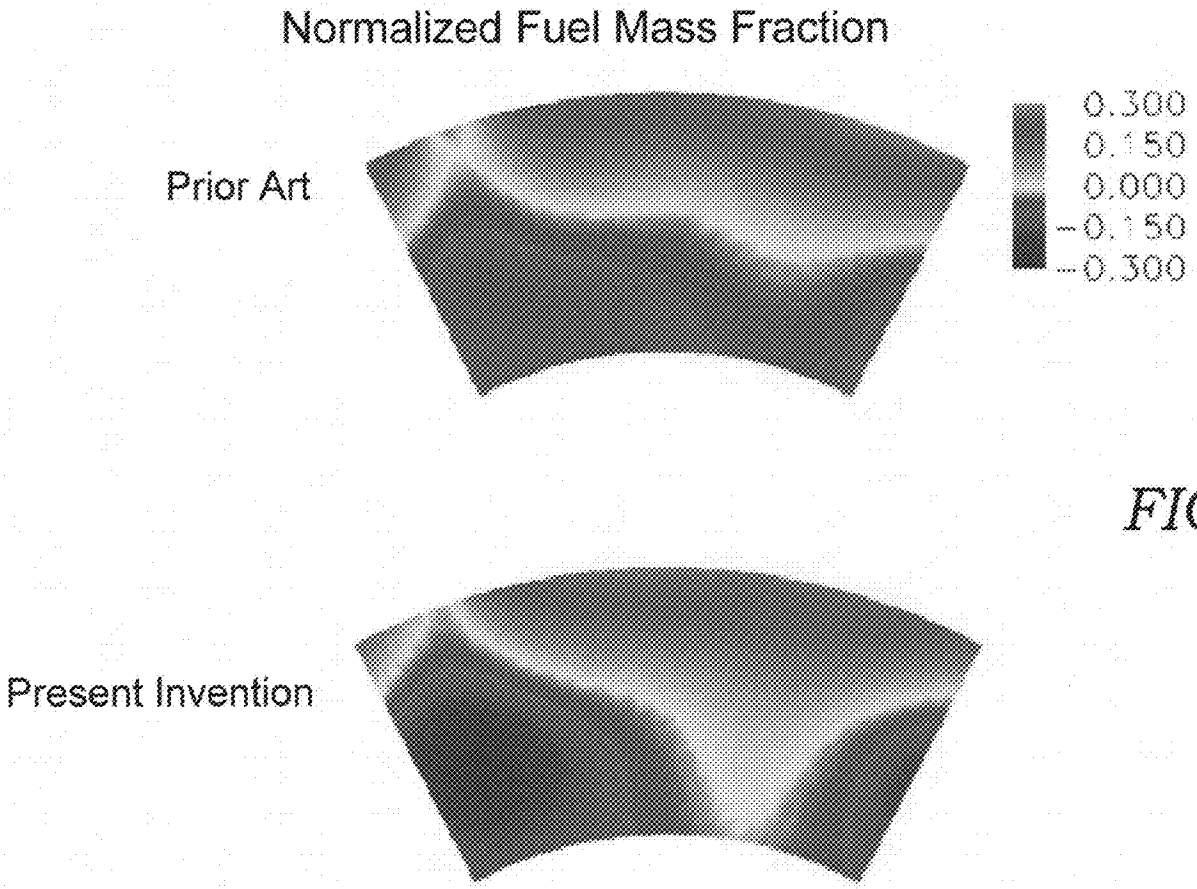
FIG. 7 depicts a comparison of normalized equivalence ratios at the entrance plane to the combustion chamber between the prior art fuel nozzle and a fuel nozzle in accordance with an embodiment of the present invention.

Referring now to FIG. 7, a comparison of a normalized equivalence ratio is shown for a combustor of the prior art (FIG. 2) compared to the combustor of the present invention (FIG. 6). FIG. 7 depicts the equivalence ratio (normalized), or actual fuel/air ratio divided by the stoichiometric fuel/air ratio, for both the prior art fuel nozzle and that of the present invention. This figure depicts a portion of the combustor looking upstream from the combustion chamber. It can be seen from these profiles that the normalized equivalence ratios for the two designs are quite similar and it has been determined through the analytical models that the unmixedness parameter of the combustor utilizing the fuel nozzle of the present invention is comparable to that of the prior art fuel nozzle. From this figure, it can be seen that the increased swirler angle in the present invention fuel nozzle has compensated for the shorter axial mixing distance and has resulted in a comparable equivalence ratio and degree of unmixedness at the combustor inlet, compared to that of the prior art. As such, upon reaction of the fuel and air mixture, little to no difference in flame temperature, emissions, or other detectable parameters would be seen based upon the mixing achieved.

Figure 8:
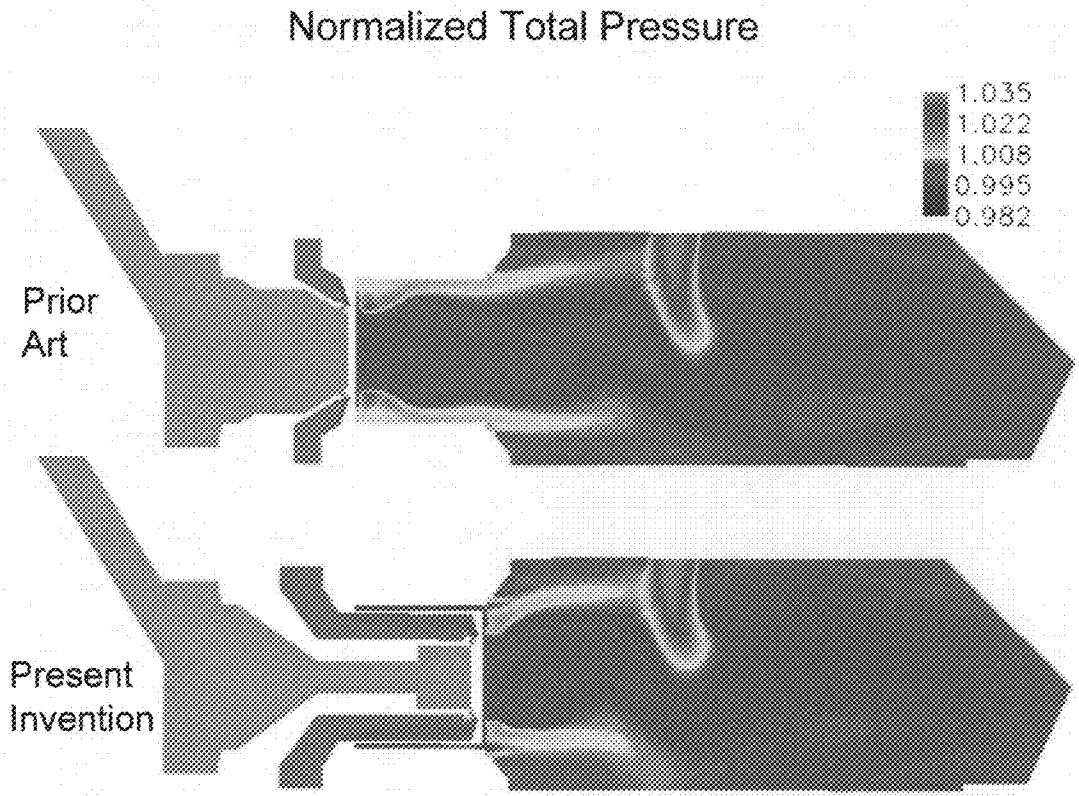
FIG. 8 depicts a comparison of normalized total pressures in the premixing chamber of a gas turbine combustor between the prior art fuel nozzle and a fuel nozzle in accordance with an embodiment of the present invention; and, FIG. 9 depicts a chart comparing normalized residence time between the prior art fuel nozzle and a fuel nozzle in accordance with an embodiment of the present invention.
Figure 9:
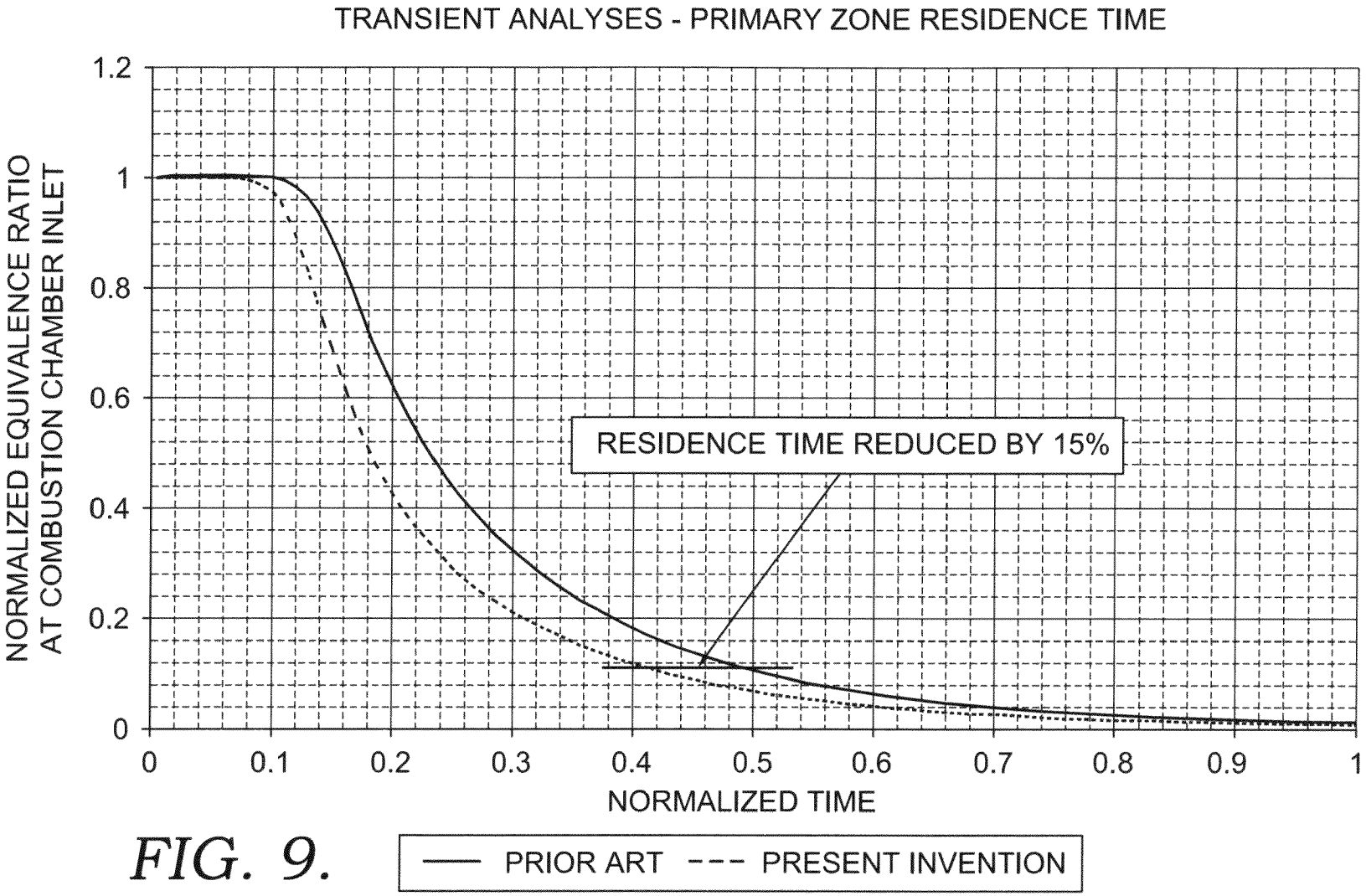

Further evidence of the improvement provided by the present invention can be found in FIG. 8, which depicts a comparison of normalized total pressure from the fuel nozzle, through the premixer, and to the combustion chamber for both the prior art fuel nozzle and that of the present invention. The present invention fuel nozzle has a similar, if not slightly smaller pressure drop than that of the prior art fuel nozzle. More importantly, the change in axial position of the fuel introduction into the premixer, which is measured in terms of a residence time, is also reduced for the present invention fuel nozzle. Referring now to FIG. 9, a normalized chart of equivalence ratio, also referred to as Phi, plotted versus normalized time (in milliseconds) is shown for both the prior art fuel nozzle and the present invention fuel nozzle. The residence time for the present invention fuel nozzle when employed in the same combustor as that of the prior art is approximately 15% less than that of the prior art. Such a reduced residence time allows for the present invention fuel nozzle to operate at higher temperatures and pressures than that of the prior art, since the time for auto-ignition to occur decreases as the pressure and temperature of the fuel/air mixture increases.

In reducing the residence time of the premixer as described herein, combustion dynamics of the system are also affected. By changing the axial location of the fuel nozzle, and hence the plane of fuel injection, the acoustic volume of the premixer is reduced. As such, the time delay from the point of fuel injection to the flame front within the combustor is reduced, and the natural frequencies at which the combustion dynamics occur are shifted. This change can be a significant advantage for combustor durability, which is closely related to both the frequency and magnitude of combustion dynamics.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A fuel nozzle for a gas turbine combustor comprising:

a centerbody extending along a nozzle axis having a first end, a second end located opposite the first end, and a first opening extending from the first end through the centerbody to a plenum;

a plurality of swirlers positioned adjacent the second end and extending radially outward from the centerbody, the swirlers oriented at an angle relative to the nozzle axis;

an outer shroud extending from the centerbody to the second end and radially encompassing the plurality of swirlers, and wherein the outer shroud has a plurality of slots located therein that are in fluid communication with a passageway formed between the outer shroud and the centerbody; and a plurality of second openings located in the centerbody adjacent to the plurality of swirlers;

wherein fuel passes through the first opening to the plenum and air passes through the passageway such that the air is separate from the fuel until the fuel and air are mixed upon exiting the fuel nozzle at the second end of the fuel nozzle.

2. The fuel nozzle of claim 1, wherein the first opening tapers from a general conical cross section to a general cylindrical cross section.

3. The fuel nozzle of claim 1, further comprising a threaded portion proximate the first end.

4. The fuel nozzle of claim 1, wherein the fuel impinges on the second end of the centerbody to provide active cooling to the fuel nozzle.

5. The fuel nozzle of claim 1, wherein air passes through the plurality of slots, through the passageway, and through the plurality of swirlers.

6. The fuel nozzle of claim 5, further comprising a plurality of third openings located circumferentially about the outer shroud.

7. The fuel nozzle of claim 6, wherein a portion of the air flowing through the passageway exits the passageway through the third plurality of openings.

8. The fuel nozzle of claim 1, wherein the angle of the swirlers is approximately 35 degrees.

9. A gas turbine combustor having reduced residence time comprising:

a combustion liner having a first liner end, a second liner end located opposite of the first liner end and separated by one or more combustion chambers;

an end cap having at least one receptacle, the end cap affixed to the first end of the combustion liner;

at least one fuel nozzle extending through the at least one receptacle of the end cap and comprising:

a centerbody extending along a nozzle axis having a first end, a second end located opposite the first end, and a first opening extending from the first end through the centerbody to a plenum positioned adjacent the second end of the nozzle; wherein fuel passes through the first opening to the plenum and air passes through the passageway such that the air is separate from the fuel until the fuel and air are mixed upon exiting the fuel nozzle at the second end of the fuel nozzle;

a plurality of swirlers positioned adjacent the second end of the centerbody and extending radially outward from the centerbody, the swirlers oriented at an angle relative to the nozzle axis;

an outer shroud extending from the centerbody to the second end and radially encompassing the plurality of swirlers, and wherein the outer shroud has a plurality of slots located therein that are in fluid communication with a passageway formed between the outer shroud and the centerbody; and a plurality of second openings located in the centerbody adjacent to the plurality of swirlers;

wherein the at least one fuel nozzle is positioned such that the plurality of second openings of the fuel nozzle are positioned adjacent a plane defined by an intersection of the end cap and the combustion liner, whereby a distance and associated time between where fuel is injected from the at least one fuel nozzle and the combustion chamber are reduced, while conditions associated with fuel and air mixedness in the combustion chamber are maintained.

10. The gas turbine combustor of claim 9, wherein the combustion liner is generally annular and has a central liner axis.

11. The gas turbine combustor of claim 10, wherein the end cap has a plurality of receptacles located in an annular array about the central liner axis.

12. The gas turbine combustor of claim 10, further comprising a longitudinally extending secondary fuel nozzle located generally along the central liner axis.

13. The gas turbine combustor of claim 12, wherein when the at least one fuel nozzle operates in conjunction with the secondary fuel nozzle, combustion dynamics in the combustor are reduced.

14. The gas turbine combustor of claim 9, wherein a fuel passes through the first opening to the plenum and impinges on the second end of the centerbody to provide active cooling to the fuel nozzle and flows through the plurality of second openings.

15. The gas turbine combustor of claim 14, wherein air passes through the plurality of slots and the passageway, and through the plurality of swirlers of the centerbody whereby the air mixes with fuel from the plurality of second openings.

16. The gas turbine combustor of claim 15, further comprising a plurality of third openings located circumferentially about the outer shroud of the fuel nozzle and through which a portion of the air flowing through the passageway exits the passageway.

17. The gas turbine combustor of claim 16, wherein the portion of the air passing through the plurality of third openings continues through a cap passageway defined by the at least one fuel nozzle and the at least one receptacle.

* * * * *